US006540504B2

(12) United States Patent
Kobayashi et al.

(10) Patent No.: US 6,540,504 B2
(45) Date of Patent: Apr. 1, 2003

(54) COMBUSTION APPLIANCE WITH FLAME BLOCKING DEVICE

(75) Inventors: Toshihiro Kobayashi, Nagoya (JP); Hideo Chikazawa, Nagoya (JP)

(73) Assignee: Paloma Industries, Limited, Aichi (JP)

( * ) Notice: Subject to any disclaimer, the term of this patent is extended or adjusted under 35 U.S.C. 154(b) by 0 days.

(21) Appl. No.: 10/120,048

(22) Filed: Apr. 10, 2002

(65) Prior Publication Data

US 2002/0152971 A1 Oct. 24, 2002

(30) Foreign Application Priority Data

Apr. 20, 2001 (JP) ..... 2001-122494

(51) Int. Cl.[7] ..... F23N 5/10

(52) U.S. Cl. ..... 431/77; 431/75; 122/14.21; 122/504

(58) Field of Search ..... 122/14.1, 14.2, 122/14.21, 17.1, 17.2, 504; 431/75, 77

(56) References Cited

U.S. PATENT DOCUMENTS 4,355,970 A * 10/1982 Kitagawa et al. ..... 431/77
4,395,226 A * 7/1983 Nakanishi et al. ..... 431/76
5,797,355 A 8/1998 Bourke et al. ..... 122/13.1
6,003,477 A 12/1999 Valcic ..... 122/13.1
6,139,311 A * 10/2000 Bowman et al. ..... 431/278
6,412,447 B1 * 7/2002 Trant et al. ..... 122/14.21

* cited by examiner

*Primary Examiner*—Jiping Lu
(74) *Attorney, Agent, or Firm*—Pearson & Pearson, LLP

(57) ABSTRACT

A main burner 22, a pilot burner 25, and a lead-in pipe 29 supplying combustion exhaust to the pilot burner 25 are arranged in a combustion chamber R2. A flame arrester 27 with small holes 27*a* is provided at a bottom plate 13. Furthermore, a primary thermocouple 26 detecting the flame state of the pilot burner 25 and a secondary thermocouple 28 detecting the temperature in the combustion chamber R2 are connected in series but with opposite polarities. When the flame arrester 27 clogs up with fine particles, the pilot burner 25, which sucks in combustion exhaust, performs abnormal combustion before the main burner 22, which is detected by the primary thermocouple 26 and the secondary thermocouple 28, whereupon the combustion with the main burner 22 is stopped. Thus, incomplete combustion due to blocking of the air supply path can be prevented.

2 Claims, 3 Drawing Sheets

COMBUSTION APPLIANCE WITH FLAME BLOCKING DEVICE

BACKGROUND OF THE INVENTION

1. Field of the Invention

The present invention relates to a combustion appliance with flame blocking device, which can be installed in a garage, a basement, a storehouse or other places where flammable materials generating flammable gases, such as gasoline, thinner or benzine, are kept.

2. Description of the Related Art

Conventionally, water heaters with flame blocking devices are provided with a hot-water storage chamber R1 and a combustion chamber R2, which are arranged one above the other inside a hollow cylindrical main body 11, as shown in FIG. 4. In a known water heater, the combustion chamber R2 is provided with an air supply port 13*a* through which air is taken in, a main burner 22 combusting fuel gas, and a pilot burner 4 for carrying the flame over the main burner 22. An exhaust pipe 16, which passes through the axis of the hot-water storage chamber R1 and opens to the top of the main body 11, exhausts fuel gas in the combustion chamber R2 to the outside of the water heater. Furthermore, a flame arrester 27 (flame blocking device) is provided at the air supply port 13*a*.

Other aspects of the remaining configuration are as explained for the embodiments of the present invention, so that a further explanation of the corresponding numerals has been omitted.

In this water heater with flame blocking device, water that has been fed into the hot-water storage chamber R1 is heated by heat exchange with hot combustion exhaust gas that passes through the exhaust pipe 16 after combustion in the main burner 22 provided in the combustion chamber R2. The heated water is stored as hot water of a certain temperature, which can be furnished to the outside as appropriate.

If this water heater is installed near flammable material generating flammable gases, there is the risk that the flammable gases intrude through the air supply port 13*a* of the hot-water heater, and the flame of the combustion chamber R2 is propagated and makes the flammable material catch fire. Therefore, a flame arrester 27 is provided to prevent a leakage of the flame in the combustion chamber R2 through the air supply port 13*a* to the outside.

The flame arrester 27 is a plate-shaped member made of metal and provided uniformly with a multitude of tiny apertures, such as punched metal or expand metal. Each flammable gas has a so-called quenching distance, and flames are not propagated along a path when the gap is below this quenching distance. In order to utilize this quenching distance, the size of the apertures in the flame arrester 27 is set no greater than a diameter of about 1.6 mm.

However, due to their small size, the apertures of the flame arrester 27 are easily clogged by fine particles, such as fluff and dust. Therefore, when clogged, there is the risk that the air supplied to the combustion chamber R2 becomes insufficient, leading to an incomplete combustion, which may cause carbon monoxide poisoning.

In order to overcome this problem, it is an object of the present invention to provide a combustion appliance with flame blocking device, in which incomplete combustion due to blocking of the air supply path can be prevented.

SUMMARY OF THE INVENTION

A combustion appliance with flame blocking device according to claim 1 of the present invention solving the above-described problems includes:

a main burner, which burns a mixture of fuel gas and air for combustion;

an air supply path, which supplies air for combustion to a combustion chamber in which the main burner is provided;

a flame blocking device, which obstructs the passage of flames by partitioning the air supply path into a plurality of apertures;

a pilot burner disposed inside the combustion chamber, which burns a mixture of fuel gas and air for combustion that is sucked from a pilot air supply port;

a flame detecting element, which outputs a detection signal corresponding to the combustion state of the pilot burner; and an incomplete combustion prevention device, which prevents incomplete combustion with the main burner in response to the signal from the flame detecting element;

wherein, when a flow of combustion exhaust generated by combustion with the main burner stagnates, the pilot burner sucks in combustion exhaust from the pilot air supply port.

In accordance with a combustion appliance with flame blocking device according to claim 2, in the combustion appliance with flame blocking device according to claim 1, the flame detecting element is a primary thermocouple;

a secondary thermocouple which detects the stagnancy of the combustion exhaust by an increase in temperature is provided; and the secondary thermocouple is connected in series but with opposite polarity to the primary thermocouple.

In the above-described combustion appliance with flame blocking device according to claim 1 of the present invention, when fine particles such as fluff or dust enters the air supply path and clogs the flame blocking device, the supply and exhaust of air to/from the combustion chamber cannot be performed smoothly and the combustion exhaust tends to stagnate.

In this situation, the pilot burner sucks in this combustion exhaust with low oxygen concentration as the air for combustion from the pilot air supply port, so that the combustion state of the pilot burner deteriorates before the main burner performs incomplete combustion, and the flame of the pilot burner is lifted due to the lack of oxygen. The flame detection element detects this change in the combustion state, and the incomplete combustion prevention device is activated.

In the combustion appliance with flame blocking device according to claim 2 of the present invention, the secondary thermocouple is connected with a polarity that is opposite to that of the primary thermocouple, so that its electromotive force acts negatively and reduces the combined electromotive force with the primary thermocouple.

When the apertures of the blocking device clog up, the flame of the pilot burner is lifted due to the lack of oxygen and the electromotive force of the primary thermocouple is decreased. Moreover, since the detected temperature of the secondary thermocouple increases, the combined electromotive force drops sharply below that of the normal combustion state, so that the lack of oxygen can be detected with high sensitivity, and the incomplete combustion prevention device is activated.

DESCRIPTION OF THE PREFERRED EMBODIMENTS

The configuration and operation of the present invention as described above shall become clearer upon consideration of the following preferred embodiments of a combustion appliance with flame blocking device in accordance with the present invention.

Figure 1:
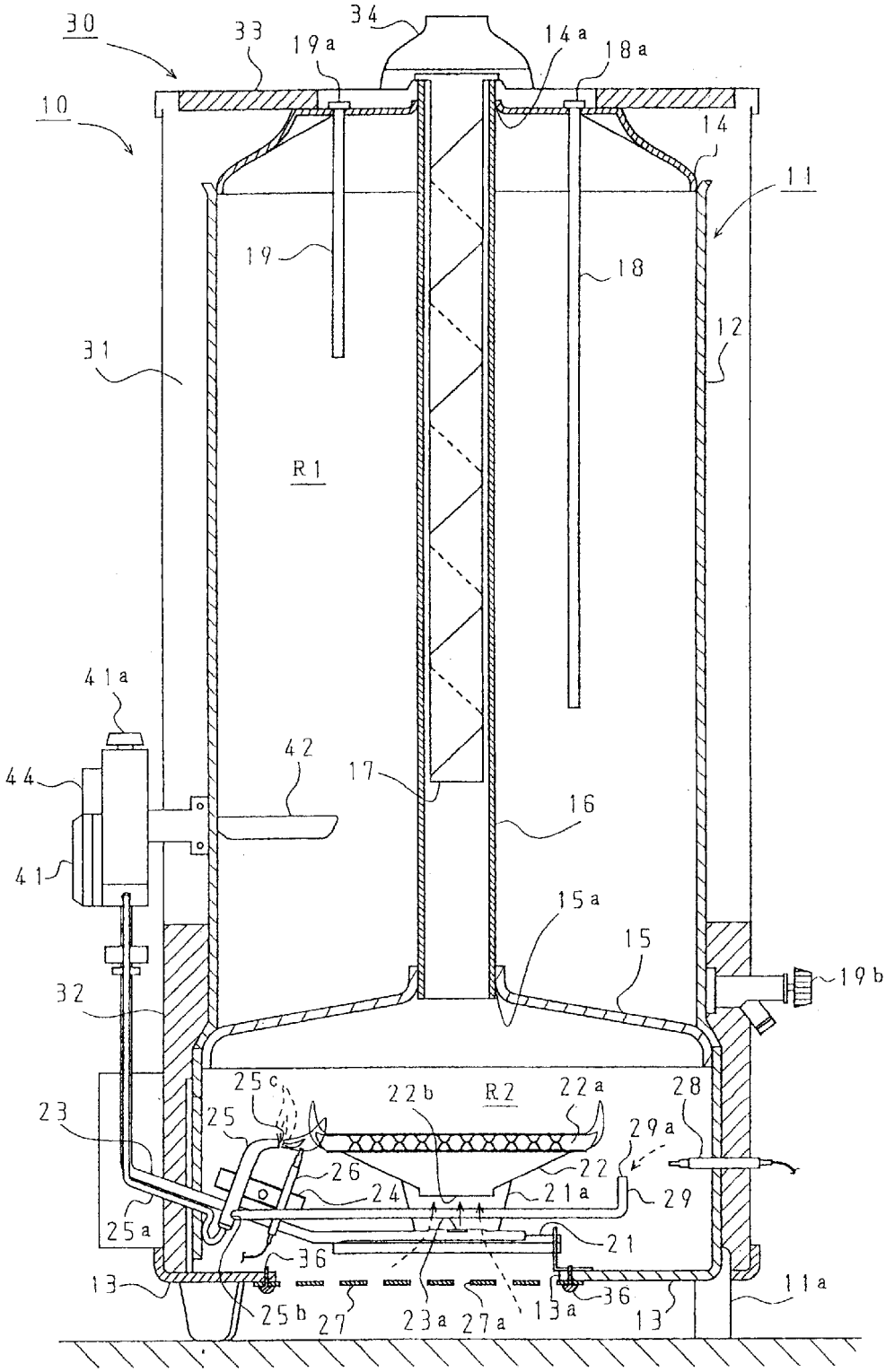
FIG. 1 is a diagrammatic cross-sectional view of a water heater with flame blocking device in an embodiment of the present invention, seen from the front.

FIG. 1 illustrates the overall configuration of a water heater with flame blocking device (simply referred to as water heater herein after). This water heater 10 includes a main body 11, which is a cylindrical container made of steel that is closed at the top and the bottom and whose inner surface has been covered with enamel. The water heater also includes an outer case 30 covering the circumference and the upper side of the main body 11, and a controller 41 controlling the operation of the water heater 10.

The main body 11 of the water heater 10 includes a cylindrical portion 12, a flat bottom plate 13 that closes off the bottom, and a spherical top end plate 14 of slightly upward bulging spherical shape that closes off the top. The main body 11 stands on the floor with legs 11*a* that are provided at the bottom plate 13.

The main body 11 is further provided with a lower end plate 15 of slightly upward bulging spherical shape that is disposed coaxially at a certain position on the side of the bottom plate 13 and partitions the main body 11 vertically. The lower end plate 15 divides the main body 11 into a hot-water storage chamber R1 on the upper side and a combustion chamber R2 on the lower side.

The upper end plate 14 and the lower end plate 15 are respectively provided with aperture portions 14*a* and 15*a* at an axial position, and an exhaust pipe 16, which extends in axial direction along the axis through the aperture portions 14*a* and 15*a* forming an exhaust gas path, is fastened to these aperture portions 14*a* and 15*a*. A twisted baffle plate 17 is fastened inside the exhaust pipe 16, extending from a lower position somewhat above the lower end of the exhaust pipe 16 to the upper end, and forms a helical path along the axial direction of the main body 11.

A cold-water supply pipe 18 and a hot-water supply pipe 19 are suspended from the upper end plate 14, reaching into the hot-water storage chamber R1. Furthermore, the upper end plate 14 is provided with a cold-water port 18*a* of the cold-water pipe 18 for supplying cold water into the hot-water storage chamber R1, and a hot-water port 19*a* for retrieving hot water from the hot-water storage chamber R1. Slightly above the lower end plate 15, a drainage plug 19*b* for draining hot water from the hot-water storage chamber R1 to the outside is provided.

Inside the combustion chamber R2, a baseplate 21 is provided slightly apart from the bottom plate 13. In the baseplate 21, a main burner 22, in which flame ports 22*a* are formed by constricting a multitude of locations at a circular circumference, is installed, supported by a burner support 21*a*. Below the main burner 22, a main gas supply pipe 23 is connected through the sidewall of the main body 11 to the baseplate 21. The main gas supply pipe 23 is provided with a nozzle 23*a*. The lower end 22*b* of the main burner 22 is provided with an aperture sucking in primary air for combustion (indicated by dashed lines in the drawings) and fuel gas (indicated by a solid line in the drawings) from the nozzle 23*a*.

At a side portion of the main burner 22, a continuously burning pilot burner 25 is provided, whose tip is curved toward the main burner 22, and the flame port 25*c* of the pilot burner 25 is oriented in horizontal direction.

Moreover, a primary thermocouple 26 (flame detecting element) that is heated by the flame of the pilot burner 25 and outputs an electromotive force in response to the state of the flame is fastened to a mounting plate 24, together with the pilot burner 25 but at a certain distance in horizontal direction from the pilot burner 25. As will be explained in more detail below, the primary thermocouple 26 is positioned such that a thermally sensitive portion of the primary thermocouple 26 contacts with a flame when the combustion is normal, while the thermally sensitive portion does not contact with a flame when the combustion has deteriorated due to insufficient air supply. That is to say, the thermally sensitive portion of the primary thermocouple 26 is located on the extension of the direction in which mixed gas spouts from the pilot burner 25.

In the region below the flame ports 22*a* of the main burner 22, a secondary thermocouple 28 is provided, which outputs an electromotive force in response to the temperature around it.

In the bottom plate 13, an air supply port 13*a* is formed, through which air for combustion is supplied to both the main burner 22 and the pilot burner 25, and a flame arrester 27 serving as a flame blocking device is fastened with screws 36 to the air supply port 13*a*.

The flame arrester 27 is a plate-shaped member of punched metal having a multitude of small holes 27*a* with a diameter of 1.6 to 3 mm. It should be noted that it is also possible to connect an air supply pipe to the bottom plate 13, and to fit the frame arrester into this air supply pipe.

At the lower end of the pilot burner 25, a pilot air supply port 25*b* is formed, and slightly below the main burner 22, a lead-in pipe 29 is installed, which is connected to the pilot air supply port 25*b*. The inlet port 29*a* of this lead-in pipe 29 is arranged in a region below the flame ports 22*a* of the main burner 22. Moreover, a pilot gas supply pipe 25*a* is connected to the pilot burner 25.

The main burner 22 sucks in primary air (indicated by the dashed lines in the drawings) from the lower end aperture 22*b*, which is drawn in by the gas (indicated by the solid line in the drawings) gushing from the nozzle 23*a* connected to the gas supply pipe 23. Similarly, also the pilot burner 25 sucks in primary air (indicated by the dashed lines in the drawings) from the inlet port 29*a* of the lead-in pipe 29, which is drawn in by the gas gushing from the nozzle (not shown in the drawings) connected to the gas supply pipe 25*a*.

The outer case 30 covers the outer circumference and the top of the main body 11 with a heat insulating material. From the top to a position slightly above the lower end plate 15, the cylindrical portion of the outer case 30 is made of a heat insulating material 31 of polyurethane resin, and the portion below it is a glass fiber heat insulating material 32 made of a resin into which fiberglass has been mixed. On the upper surface of the outer case 30, a ring-shaped top plate 33 is buried into the polyurethane resin portion, and a hood 34 is attached, which covers the end of the exhaust pipe 16 protruding from the upper surface.

A controller 41 is provided outside the outer case 30, at the lower end of the heat insulating material 31. On the side of the controller 41, a thermostat 42 is provided, which protrudes into the hot-water storage chamber R1 through the heat insulating material 31 and the cylindrical portion 12. Furthermore, an electromagnetic safety valve for opening and closing the path to the pilot burner 25 and the main burner 22 is built into the controller 41. The primary thermocouple 26 and the secondary thermocouple 28 are connected in series but with opposite polarity to the controller 41.

An alarm buzzer 44 is connected to the controller 41. Also built into the controller 41 is a thermostat valve that closes the main gas path when the temperature detected by the thermostat 42 is at or above a certain temperature T1, thus the gas supply to the main burner 22 is stopped. When the detected temperature is at or below a certain temperature T2 (<T1), the thermostat valve opens, the gas supply to the main burner 22 is begins, and the pilot burner 25 serving as the ignition burner ignites the main burner 22, so that combustion with the main burner 22 begins. During the combustion, air is supplied by natural draft from the air supply port 13*a* to the combustion chamber R2.

Also when due to insufficient air supply the composite electromotive force of the primary thermocouple 26 and the secondary thermocouple 28 drops below a predetermined value, the controller 41 closes the gas path to the main gas supply pipe 23, thus stopping the gas supply to the main burner 22 and preventing incomplete combustion with the main burner 22, and causes the alarm buzzer 44 to ring.

The following explains how the water heater 10 with the above-described configuration operates.

First, when the pilot burner 25 is ignited by pressing down an ignition knob 41*a* at the top of the controller 41, an electromotive force is generated by the primary thermocouple 26, which is heated by the flame formed in horizontal direction from the flame port 25*c*, and this electromotive force holds the electromagnetic safety valve in its open state. In this situation, the pilot burner 25 continues to burn even when temporarily removing the hand from the ignition knob 41*a*. Moreover, if the ignition knob 41*a* is turned to the left and the main gas path is opened, the flame from the pilot burner 25 is passed on, igniting the main burner 22. With this start of operation of the water heater 10, the state of the flame of the pilot burner 25 is detected by the primary thermocouple 26.

Figure 2:
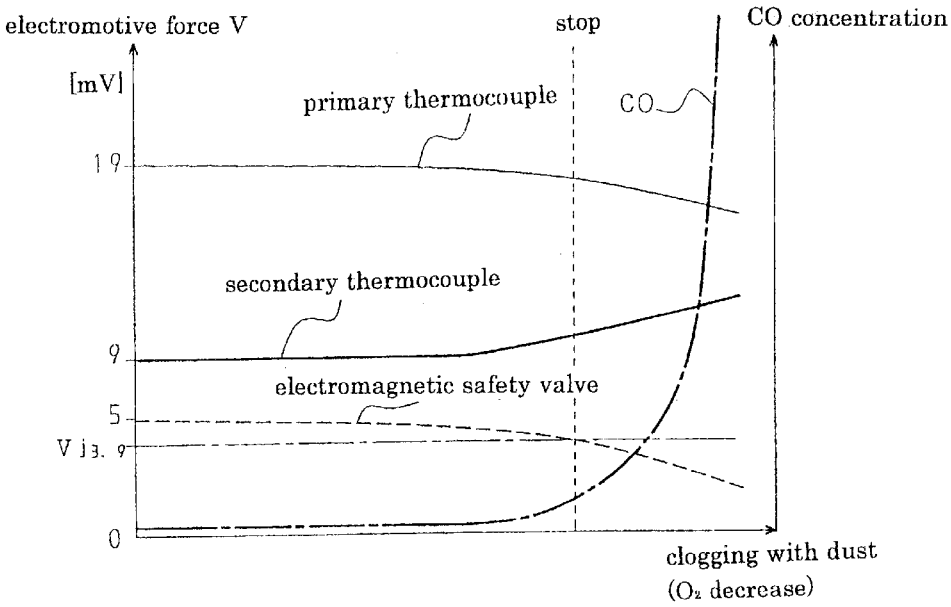
FIG. 2 shows the relation between the clogging of the air supply and the electromotive force.

When the small holes 27*a* in the flame arrester 27 are not clogged and sufficient fresh air is supplied from the lead-in pipe 29 to the pilot burner 25, the flame of the pilot burner 25 assumes the state indicated by the solid line in FIG. 1. Under these conditions, the electromotive force V generated by the primary thermocouple 26 stabilizes at a high value (19 mV, solid line) as shown in FIG. 2. On the other hand, the combustion chamber R2 warms up due to the combustion heat of the main burner 22, and the secondary thermocouple 28 generates a weaker electromotive force (9 mV, dashed line).

Consequently, the combined electromotive force generated by the two thermocouples 26 and 28 takes on the value obtained by subtracting the electromotive force of the secondary thermocouple 28 from the electromotive force of the primary thermocouple 26. Due to the set-up of the circuit resistances in this embodiment, the voltage applied to the coil of the electromagnetic safety valve is about half the value of the combined electromagnetic force (5 mV, dashed line). Therefore, since the voltage is higher than a reference value Vj (3.9 mV, dash-dotted line) at which combustion is determined to be abnormal, the combustion operation of the main burner 22 is not stopped.

Here, the temperature of the hot water in the hot-water storage chamber R1 is still low, so that the thermostat valve built into the controller 41 is open, and the main burner 22 receives the flame from the pilot burner 25 and starts combustion.

High-temperature combustion exhaust gas generated by the combustion rises up in the exhaust pipe 16 while heating the lower end plate 15, and the combustion exhaust gas passes through the baffle plate 17, whereby the hot water in the hot-water storage chamber R1 is heated, and its temperature rises. When the temperature of the hot water is at or above T1, the thermostat 42 detects this, closes the thermostat valve, and the flame of the main burner 22 is extinguished.

When the temperature of the hot water drops or hot water is retrieved through the hot-water supply pipe 19 and cold water is filled in through the cold-water supply pipe 18 accordingly, so that the temperature of the hot water drops to T2 or below, then the thermostat 42 detects this temperature drop, and the main gas path is opened by opening the thermostat valve. Thus, resuming the combustion of the main burner 22 and heating the hot water in the hot-water storage chamber R1.

As the heating of the hot water in the hot-water storage chamber R1 by combustion with the main burner 22 is repeated and the small holes 27*a* of the flame arrester 27 start to clog up with fine particles, the amount of air that is supplied to the combustion chamber R2 is reduced, and also the supplied amount of oxygen is reduced. As a result, the combustion state of the pilot burner 25 deteriorates.

In addition, due to the clogging of the flame arrester 27, the air supply and exhaust to/from the combustion chamber R2 is not performed smoothly, and the combustion exhaust stagnates and goes down to the bottom in the combustion chamber R2. Consequently, the combustion exhaust is sucked in from the lead-in pipe inlet port 29*a*, which is arranged lower than the flame ports 22*a* of the main burner 22, and the combustion state of the pilot burner 25 worsens.

As a result, the flame formed in horizontal direction from the flame port 25*c* of the pilot burner 25 is lifted upward due to a lack of oxygen as indicated by the dashed line in FIG. 1, and does not reach the primary thermocouple 26 anymore. Thus, the electromotive force V of the primary thermocouple 26 drops as shown by the solid line in FIG. 2.

In addition, when the flame arrester 27 clogs up and the supply and exhaust of air to/from the combustion chamber R2 cannot be performed smoothly, the stagnant high-temperature combustion exhaust fills up the combustion chamber R2 while lowering to the vicinity of the secondary thermocouple 28. As a result, the temperature in the vicinity of the secondary thermocouple 28 increases, and the electromotive force (indicated by the bold solid line in FIG. 2) of the secondary thermocouple 28 increases, so that the combined electromotive force (indicated by the dashed line in FIG. 2) drops sharply below that of normal combustion, and the lack of oxygen can be detected with sensitivity.

The controller 41 receiving the result of this detection closes the built-in electromagnetic safety valve, and stops the gas supply to the main burner 22, which lets the alarm buzzer 44 ring.

In other words, before the flame arrester 27 clogs up and the main burner 22 performs an incomplete combustion, the deterioration of the combustion state of the pilot burner 25 is detected, and the combustion with the main burner 22 is stopped, so that incomplete combustion with the main burner 22 can be prevented.

Hearing the ringing of the alarm buzzer 44 during the incomplete combustion prevention operation, the user can remove the flame arrester 27 from the main body 11, resolve the clogging by removing the fine particles, and attach the flame arrester 27 again to the main body 11. Accordingly, the user can return the main burner 22 to the normal combustion state, heating the hot water inside the hot-water storage chamber R1.

Furthermore, the flame port 25*c* of the pilot burner 25 is arranged horizontally, so that the primary thermocouple 26 can be arranged at a certain horizontal distance away from the flame port 25*c*. Moreover, the flame heats up the primary thermocouple 26 during normal combustion, while the flame does not touch it when the combustion has deteriorated. As a result, a large difference in the respective electromotive forces can be attained, and the combustion state of the pilot burner 25 can be detected with high sensitivity.

Furthermore, also when the oxygen concentration of the room in which the water heater 10 is installed drops, the combustion state of the pilot burner 25 deteriorates, and the pilot burner 25 sucks in combustion exhaust, deteriorating the combustion state even more. Consequently, the electromotive force of the primary thermocouple 26 is lowered and a lack of oxygen due to pollution of the room can be detected with high sensitivity.

Moreover, by letting the pilot burner 25 for detecting the clogging also serve as the ignition burner, the number of burners does not increase, so that the manufacturing costs can be reduced.

The foregoing is an explanation of an embodiment of the present invention. However, the present invention is not limited to this embodiment, and can be embodied in many variations within a scope that does not depart from the spirit of the invention.

For example, if the combustion chamber R2 is high, then the position at which the combustion exhaust becomes thick is also high, so that it is also possible to arrange the position of the inlet port 29*a* of the lead-in pipe 29 above the main burner 22. In other words, it is desirable that the inlet port 29*a* is disposed at a position in which the combustion exhaust becomes thick.

Figure 3:
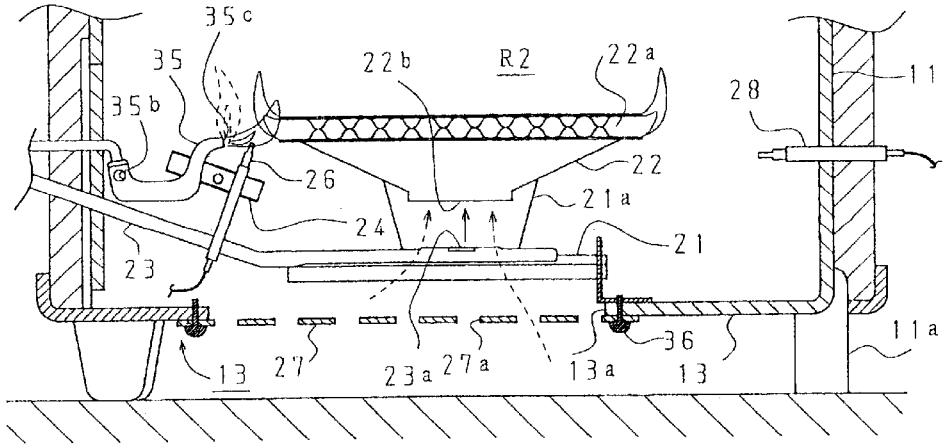
FIG. 3 is a cross-sectional view of the region near the burner in a modified example, seen from the side.
Figure 4:
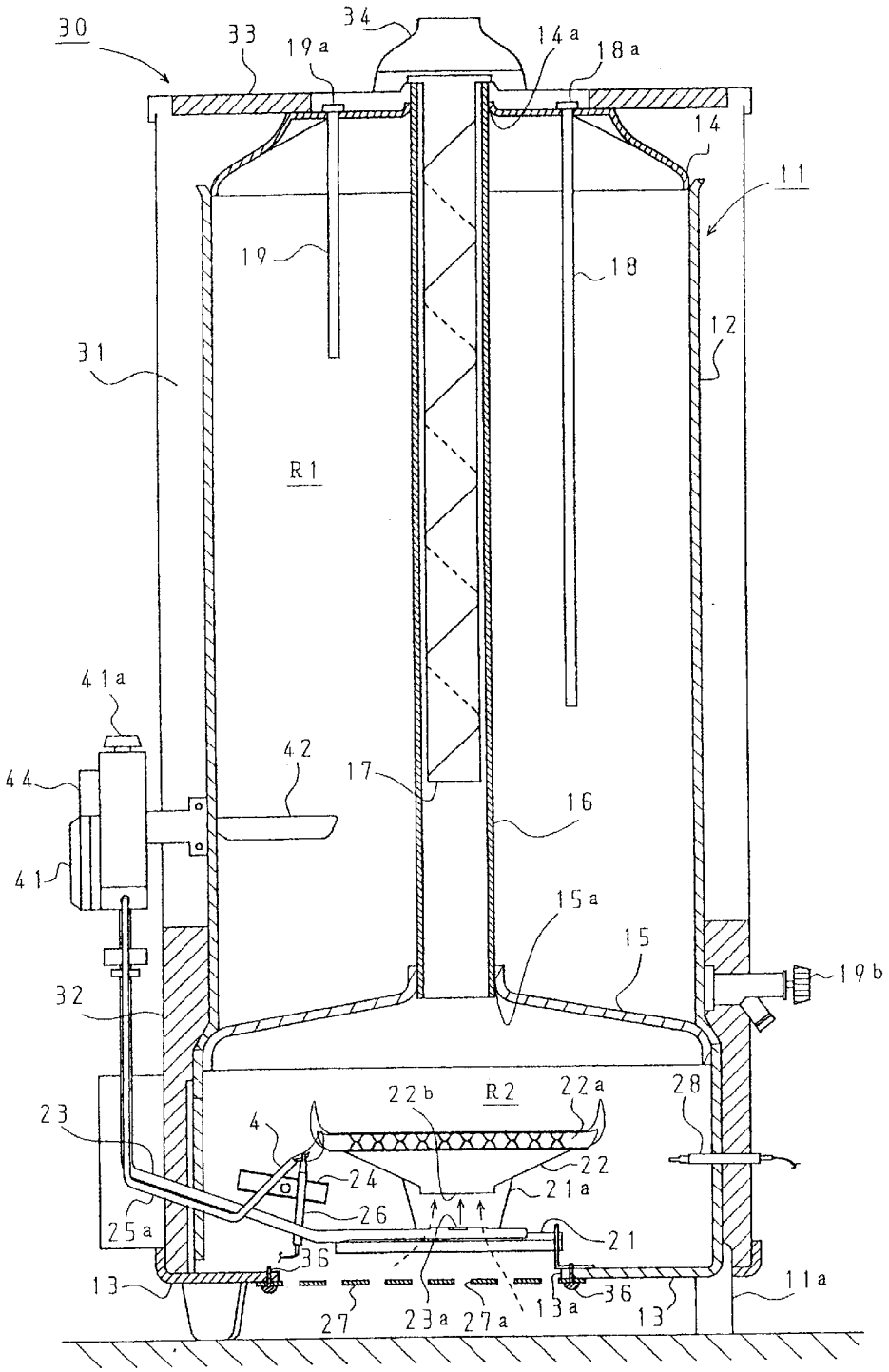
FIG. 4 (PRIOR ART)
FIG. 4 is a diagrammatic cross-sectional view of a water heater with flame blocking device in a conventional example, seen from the front.

Furthermore, the pilot burner does not necessarily have to be provided with a lead-in pipe 29. For example, as shown in FIG. 3, when a pilot air supply port 35*b* is formed in an upstream portion of the pilot burner 35, and the pilot air supply port 35*b* is arranged at a position where the combustion exhaust is thick, for example slightly below the flame port 22*a* of the main burner 22. By applying the structure, the pilot burner 35 can take in the combustion exhaust inside the combustion chamber R2 as the primary air for combustion directly through the pilot air supply port 35*b*. As a result, the lead-in pipe 29 becomes unnecessary, and the number of components can be diminished, thus reducing costs.

Furthermore, there is no limitation regarding the location for the secondary thermocouple 28. It is sufficient if the secondary thermocouple 28 is arranged at a location where a temperature increase in the combustion chamber R2 due to the clogging of the flame arrester 27 can be detected with sensitivity, and it can for example be arranged in the vicinity and directly above the flame arrester 27.

Furthermore, a configuration in which the clogging is detected only by the primary thermocouple 26 is also possible and it is not necessary that the secondary thermocouple 28 is provided in that case.

As explained in detail above, in the combustion appliance with flame blocking device according to claim 1 of the present invention, when the flame blocking device is clogged, the pilot burner sucks in the combustion exhaust in the combustion chamber as air for combustion, mixing it with fuel gas, and burns it. As a result, the combustion state of the pilot burner deteriorates before that of the main burner, and the incomplete combustion prevention device is activated when this is detected. Consequently, carbon monoxide poisoning can be prevented, which makes the combustion appliance safer.

Furthermore, in the combustion appliance with flame blocking device according to claim 2 of the present invention, the secondary thermocouple detects an increase in the temperature due to clogging of the flame blocking device. Further, the secondary thermocouple is connected to the primary thermocouple with opposite polarity. As a result, the clogging of the flame blocking device can be detected with high sensitivity, and incomplete combustion prevention can be carried out swiftly.

What is claimed is:

1. A combustion appliance with flame blocking device, comprising:

a main burner, which burns a mixture of fuel gas and air for combustion;

an air supply path, which supplies air for combustion to a combustion chamber in which the main burner is disposed;

a flame blocking device, which obstructs the passage of flames by partitioning the air supply path into a plurality of apertures;

a pilot burner disposed inside the combustion chamber, which burns a mixture of fuel gas and air for combustion that is sucked from a pilot air supply port;

a flame detecting element, which outputs a detection signal corresponding to the combustion state of the pilot burner; and an incomplete combustion prevention device, which prevents incomplete combustion with the main burner in response to the signal from the flame detecting element;

wherein, when a flow of combustion exhaust generated by combustion with the main burner stagnates, the pilot burner sucks in combustion exhaust from the pilot air supply port.

2. The combustion appliance with flame blocking device according to claim 1, wherein the flame detecting element is a primary thermocouple;

wherein a secondary thermocouple which detects the stagnancy of the combustion exhaust by an increase in temperature is provided; and the secondary thermocouple is connected in series but with opposite polarity to the primary thermocouple.

* * * * *